United States Patent [19]

Sartorio

[11] Patent Number: 4,991,422

[45] Date of Patent: Feb. 12, 1991

[54] PLATE BENDING MACHINE

[75] Inventor: Franco Sartorio, Turin, Italy

[73] Assignee: Amada Company, Limited, Japan

[21] Appl. No.: 351,212

[22] Filed: May 15, 1989

[30] Foreign Application Priority Data

May 16, 1988 [IT] Italy ..... 67451 A/88

[51] Int. Cl.[5] ..... B21D 5/02

[52] U.S. Cl. ..... 72/311; 72/306; 72/389; 72/447; 72/472

[58] Field of Search ..... 72/311, 306, 293, 389, 72/414, 416, 384, 406, 422, 472, 446, 447, 461, 8

[56] References Cited

U.S. PATENT DOCUMENTS

| | | | |
|---|---|---|---|
| 1,034,480 | 8/1912 | Meadowcroft | 72/447 |
| 2,099,624 | 11/1937 | Robarge | 72/403 |
| 2,141,657 | 12/1938 | Meier | 72/447 |
| 2,287,933 | 6/1942 | Green | 72/403 |
| 4,043,165 | 8/1977 | Badger et al. | 72/384 |
| 4,426,873 | 1/1984 | Pearson et al. | 72/389 |
| 4,672,835 | 6/1987 | Liet | 72/389 |
| 4,872,862 | 10/1989 | Ewald | 72/7 |

FOREIGN PATENT DOCUMENTS

| | | | |
|---|---|---|---|
| 354146 | 6/1922 | Fed. Rep. of Germany | 72/389 |
| 425701 | 6/1967 | Switzerland | 72/472 |
| 785630 | 10/1957 | United Kingdom | 72/311 |

*Primary Examiner*—Daniel C. Crane

*Attorney, Agent, or Firm*—Wigman & Cohen

[57] ABSTRACT

The machine includes a U-shaped pincer (12) with a pair of arms (14, 16) which carry a V-sectioned linear punch (P) and a V-sectioned linear die (D) respectively. The punch (P) is fixed and the die (D) is movable. The U-shaped pincer (12) is mounted so that it can rotate both about a bending axis (V) coincident with the edge of the punch (P) and about a horizontal pivoting axis (O) which intersects the bending axis (V). A clamp (10) is adapted to grip an upper edge of a piece (W) of sheet metal so that a region thereof to be bent lies in a vertical suspension plane (B) lying between the arms (14, 16) of the U-shaped pincer (12) and containing the bending axis (V). The U-shaped pincer (12) and the clamp (10) are capable of relative movement both in a vertical direction (Z) and in a horizontal direction (X) perpendicular to the horizontal pivoting axis (O).

9 Claims, 13 Drawing Sheets

A
B
α
L1
L2
W
V
P
D
F1
F2
F3

A
B
P
V
D
W
L1
L2
F1
F4
α

W
L2
L1
V
10
P
D
F1
14
12
16
S
18
F4
F5
F6
F7
Z
Y
X
G

PLATE BENDING MACHINE

BACKGROUND OF THE INVENTION

1. Field of the Invention

The present invention relates to a plate bending machine and more specifically to a plate bending machine for manufacturing pieces of bent sheet metal.

2. Description of the Prior Art

The invention has been developed to resolve the problem of bending sheet-metal pieces of complex shape, such as, for example, those illustrated in FIGS. 1*a* and 1*b* of the appended drawings.

Pieces of this type are frequently found in machines such as photocopiers, facsimile machines, and various electronic equipment. These products evolve rapidly, so that a manufacturer frequently changes models from one year to the next. Each new model is the result of a complete redesign even as regards the various sheet-metal pieces it contains.

These bent sheet-metal pieces are thus manufactured in relatively small runs, which do not therefore justify complicated and expensive tooling and dies: they are manufactured from pre-blanked pieces which are then subjected to various bending operations rather as in a workshop, making use of normal existing bending presses, for example, presses including fixed frames with a V-sectioned linear punches and dies movable with vertical relative movement towards and away from each other. Since successive bending operations, which are carried out from the periphery of the piece, cannot all be effected by the same die-punch pair, the manufacturer must have several presses available, each equipped with a different die-punch pair, or must replace the die and the punch whenever it is necessary.

SUMMARY OF THE INVENTION

The object of the present invention is to produce a machine which departs radically from tradition to enable the automatic manufacture of pieces of different shapes and the execution of all the successive bends of each piece in a single bending cycle.

The object of the invention is achieved by means of a machine having means (58) for supporting a workpiece; a punch and a die (P, D) for bending the workpiece at a predetermined bending axis in cooperation with each other; and means (12) for supporting the punch and the die in a rotatable manner around the bending axis.

BRIEF DESCRIPTION OF THE DRAWINGS

These and other objects, features, and advantages of the present invention will become more apparent from the following description of the preferred embodiments taken in conjunction with the accompanying drawings, in which.

DETAILED DESCRIPTION OF THE PREFERRED EMBODIMENTS

Figure 1B:
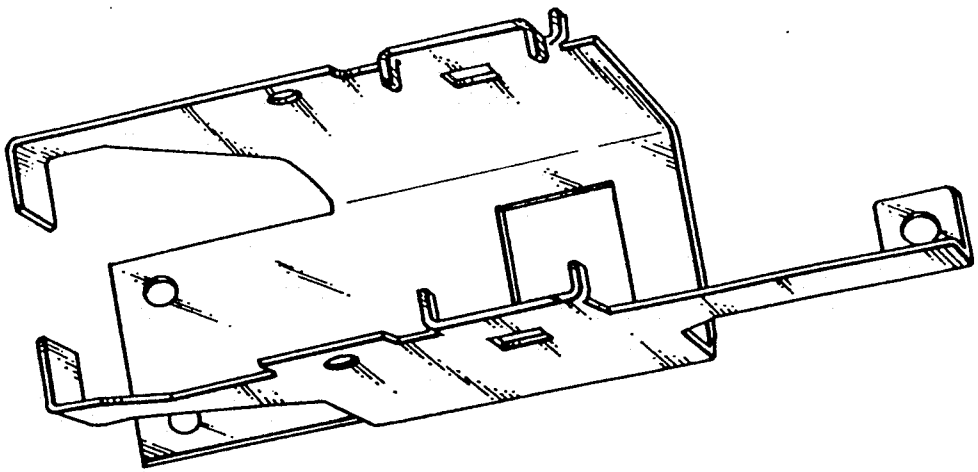
FIGS. 1*a* and 1*b* are perspective representations of two bent sheet-metal pieces of complex shape, which constitute examples of what can be produced with a single bending cycle by means of a machine according to the invention.
Figure 1A:
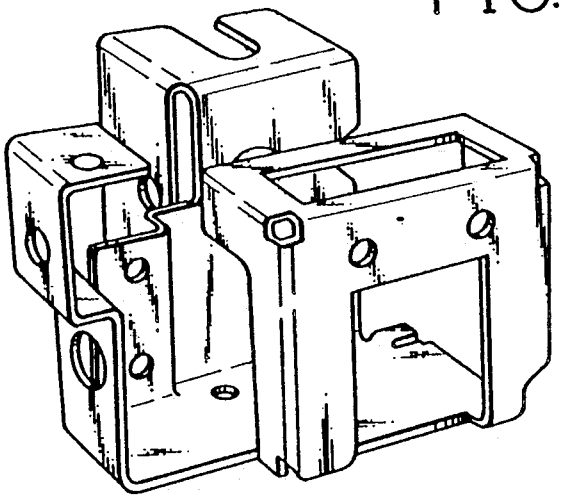
Figures 2A, 2B, 2C, 2D:
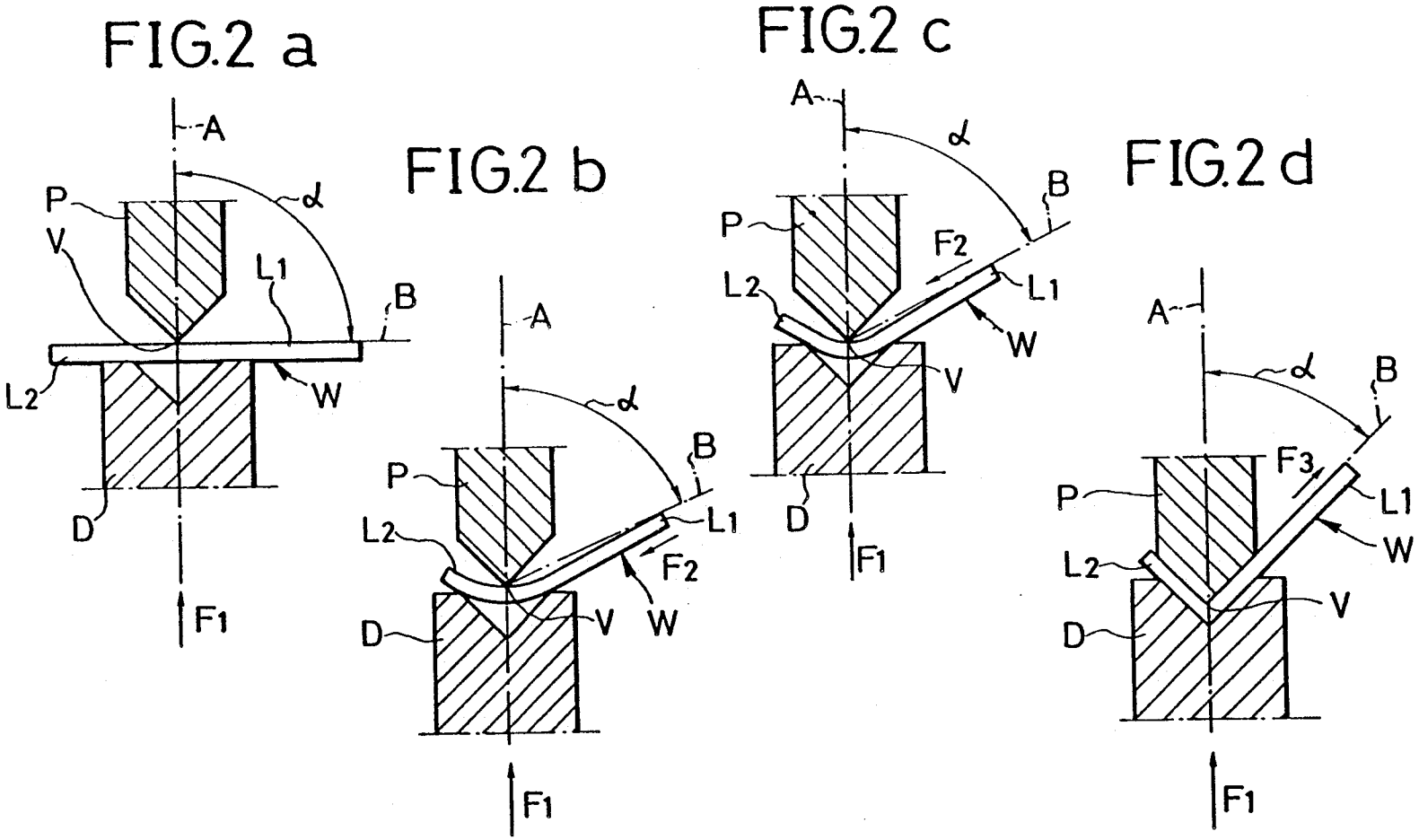
FIGS. 2*a, b, c* and *d* are schematic representations of an operation to bend a sheet-metal piece and serve to explain the concept on which the invention is based.

Reference will be made first of all to FIGS. 2*a, b, c* and *d*. For simplicity, the bending of a piece of sheet metals through 90° bend is obtained with the use of a V-sectioned linear punch p and a V-sectioned linear die D which oppose and cooperate with each other. The piece of sheet metal is indicated by W. The median plane of the punch P and the die D, along which their relative movement takes place, is indicated by A. $F_1$ indicates the direction of movement of the die D towards the punch P. It is assumed that the piece W of sheet metal is initially held between the punch P and the die D (FIG. 2*a*) in an initial plane B at an angle alpha of 90° to the plane A. It is also assumed that the piece W is not held by pincers or the like and is thus free to be deformed as a result of the relative movement of the die D and the punch P.

When bending is carried out by conventional methods, the plane A is vertical and the piece W is inserted horizontally between the punch P and the die D and is bent whilst it is free to deform.

The two ends of the piece W situated on one side and on the other side of the plane A are indicated by $L_1$ and $L_2$.

If the die D is moved towards the punch P in the direction of the arrow $F_1$, the piece W is first deformed by bending below its elastic limit (FIG. 2*b*). When the elastic limit has been exceeded, the piece W begins to bend by plastic deformation (FIG. 2*c*). The final bent condition is illustrated in FIG. 2*d*.

As can be seen, during the bending, the angle alpha decreases progressively from 90° to 45°. The law according to which the angle alpha decreases with time is not constant but, like any other condition including the material and the thickness of the sheet metal, can be determined experimentally once and for all. In any case, it should be noted that the deformation of the piece W takes place at a bending axis V which coincides with the edge of the punch P.

Upon the completion of the bending, the two ends $L_1$ and $L_2$ form a 90° dihedron between them and are both inclined at 45° to the vertical. This means that one of the ends, for example $L_1$, must be gripped again in a plane which is at 45° to, or is at least different from, the initial plane. The difficulties of manipulating the piece before and after bending are thus obvious, since an end is situated in a different plane each time it has to be gripped.

Conventional bending methods with the plane A vertical and the plane B horizontal also have another serious disadvantage: if a piece of sheet metal is fairly flexible and if it is not supported near the plane A, it must be taken into account during manipulation that the region in which the piece is supported by clamps or the like before bending does not coincide with the plane B defined initially between the punch P and the die D.

In any case, it is not possible to hold the piece W by means of clamps or the like at one end, such as $L_1$, since, during bending, the latter is first withdrawn towards the bending axis V (arrow $F_2$, FIGS. 2*b*, 2*c*) and is then returned backwards (arrow $F_3$, FIG. 2*d*).

As will be understood, all these factors work against the easy and versatile manipulation of the piece W between successive bending operations.

The machine according to the invention, as defined in the claims, resolves all these problems by means of a solution which departs radically from traditional concepts.

Figures 3A, 3B, 3C, 3D:
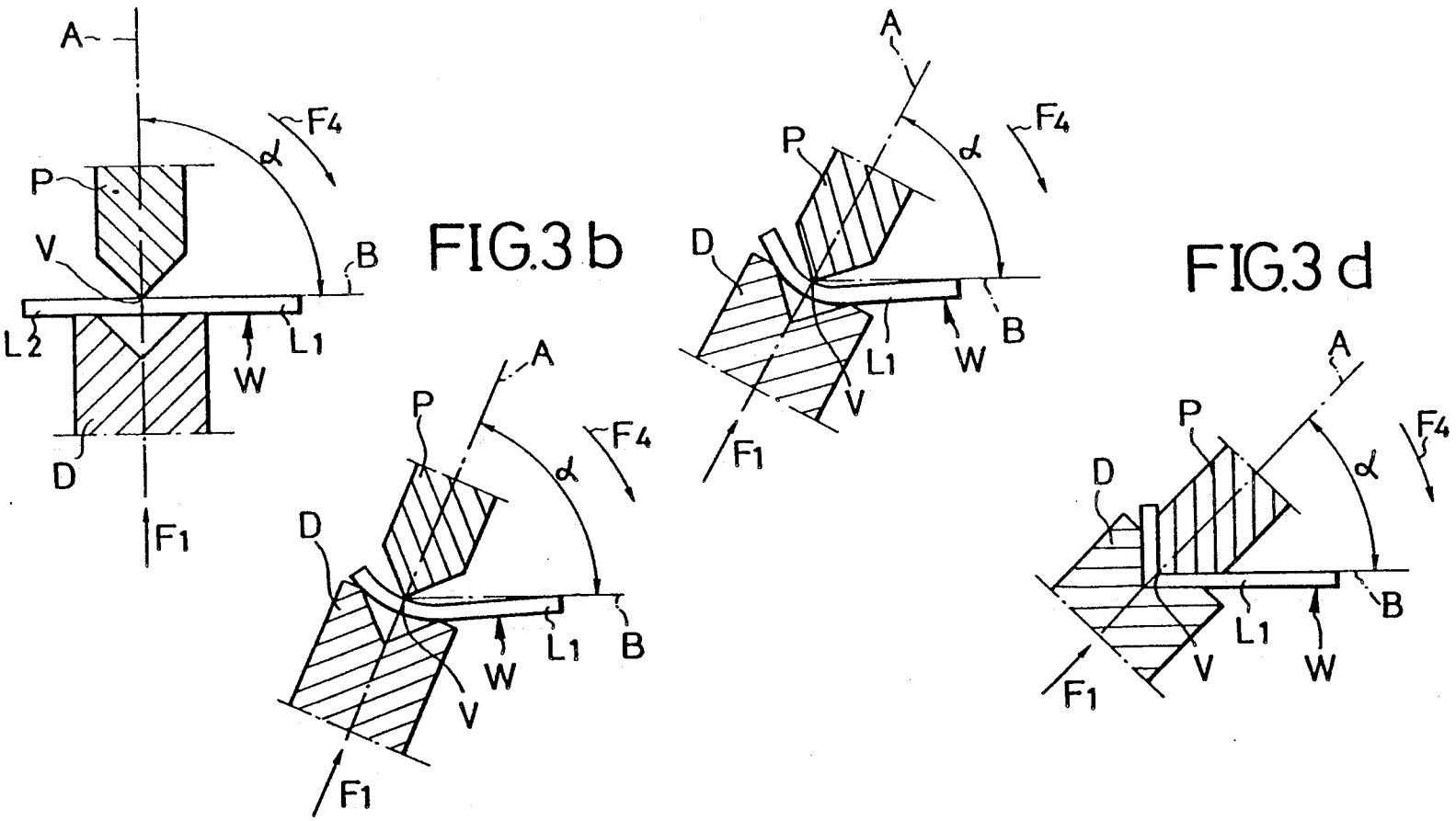
FIGS. 3*a, b, c* and *d* are schematic views of a bending operation according to the invention.

In particular:

the plane A is vertical;

the piece W is supported from above so that it is not subject to bending due to gravity;

a single clamp can hold the piece W constantly for a whole cycle of successive bendings;

assuming that the piece is supported by the clamp by its end $L_1$, this remains substantially in the same vertical plane, whilst the punch P and the die D rotate, for example, in the sense of the arrows $F_4$ as illustrated in FIGS. 3*a, b, c* and *d*, following the law of variation of the angle alpha with time;

the bending axis V is assumed to be vertical in FIGS. 3*a, b, c* and *d*, in which the references correspond to those of FIGS. 2*a, b, c* and *d;* however, as will be seen, the axis V can assume any inclination in order to achieve bends of any orientation in a piece suspended vertically from above.

These concepts will be made clearer with reference to FIGS. 4 to 9.

Figures 4, 8, 9:
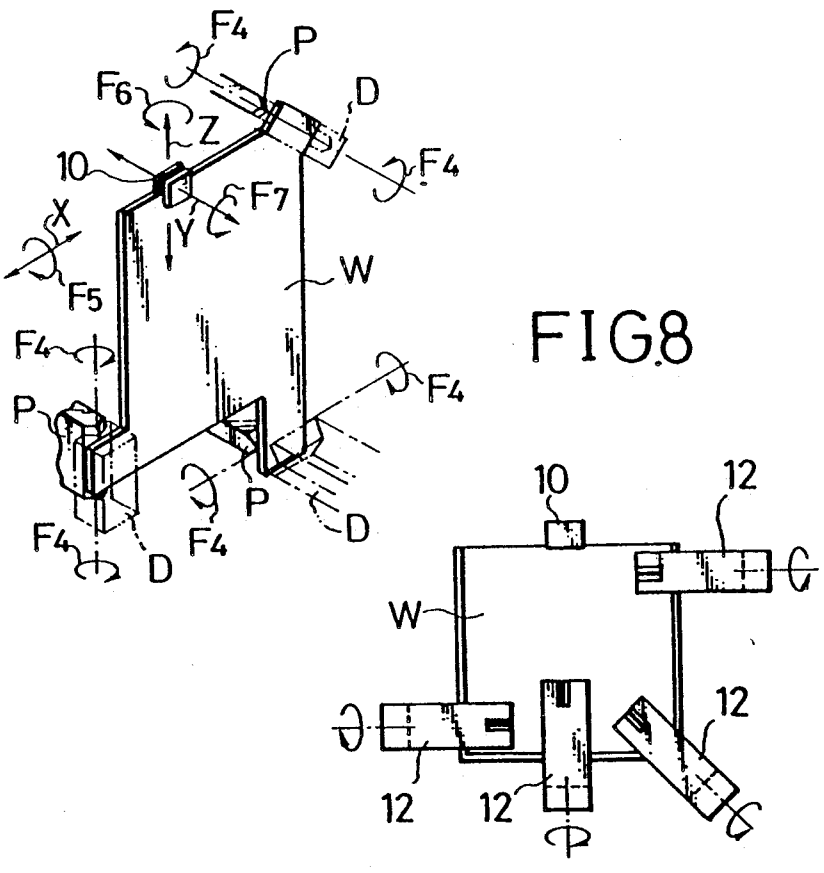
FIG. 4 is a schematic perspective view which shows a U-shaped frame provided with a die and a punch, as well as a piece of sheet metal suspended for bending.
FIG. 8 is a schematic side elevational view and FIG. 9 is a schematic perspective view which show the bending possibilities offered by a machine according to the invention.

In FIG. 4, a flat piece of sheet metal to be bent is again indicated by W.

The piece W is suspended from a clamp 10 which grips its upper edge, not necessarily in a position which corresponds to the centre of gravity of the piece.

A strong U-shaped pincer is generally indicated by a numeral 12. The pincer 12 includes a pair of arms 14 and 16 interconnected by a yoke 18. Adjacent its free end, the arm 14 carries a V-sectioned linear die, again indicated by D. The arm 16 carries a V-sectioned linear punch, again indicated by P, near its free end and facing the die D. The punch is fixed. The die D is movable towards and away from the punch P in the direction $F_1$, in a plane A perpendicular to the plane B (FIG. 3*a*) in which the piece W lies initially.

For the bending operation, the clamp 10 supports the piece W in the bending space S between the two arms 14 and 16 and keeps the piece W in a vertical attitude against the edge of the punch P. The axis along which this edge is situated is that which will define the line of bending and is again indicated by V.

As will be explained below, the pincer 12 is mounted by means of its yoke 18 so that it can rotate about the bending axis V in the sense $F_4$.

The bending axis V divides the piece W, as before, into two ends $L_1$ and $L_2$, the first of which is gripped by the clamp 10. In these conditions, the end $L_1$ will remain substantially in its initial plane during bending, while the end $L_2$ will be deflected by 90° from one side of this plane to the other.

Figure 6:
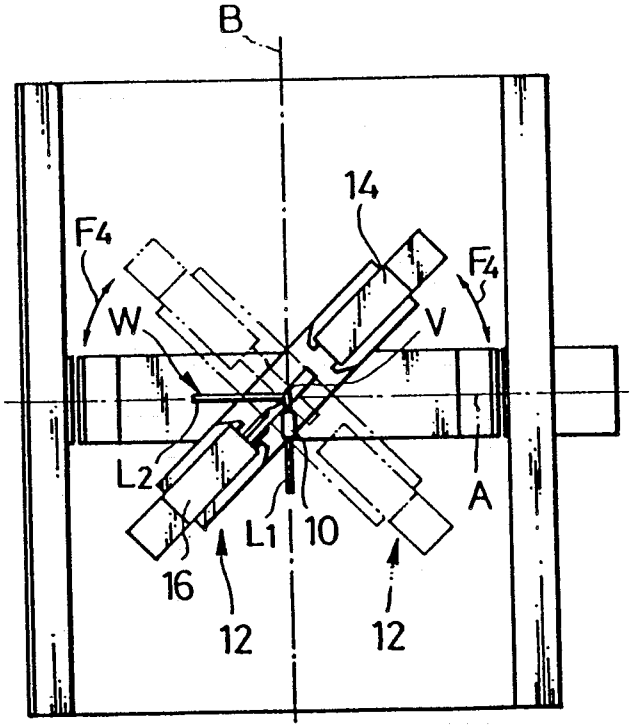
FIGS. 5 and 6 are schematic plan views of the arrangement of FIG. 4 from above, at the beginning and at the end of a bending operation respectively.
Figure 5:
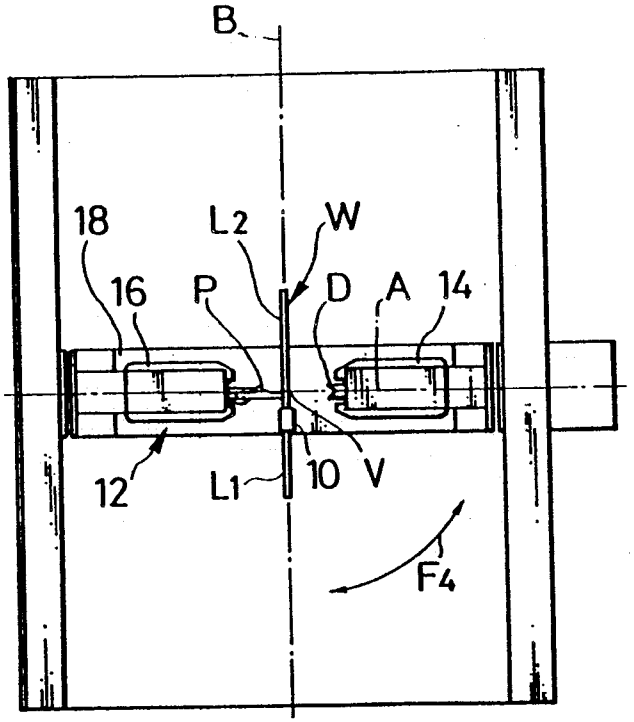

The situation of FIG. 4 is illustrated schematically in plan in FIGS. 5 and 6. $F_4$ again indicates the double sense of rotation of the pincer 12 about the bending axis V. The vertical plane in which the piece W lies initially, which is perpendicular to the axis A, is again indicated by B.

FIG. 6 shows the end $L_2$ bent at 90° with respect to the end $L_1$, which is achieved by the full advance of the die D and the rotation of the pincer 12 in the anticlockwise sense $F_4$. This rotation takes place with a predetermined law of variation of its angular velocity with time, as explained above.

FIG. 6 also shows the pincer 12, in chain outline, in a position in which it has been rotated by 45° in the opposite sense, that is, by a clockwise rotation, to achieve a bend which is the opposite of that shown.

Figure 7:
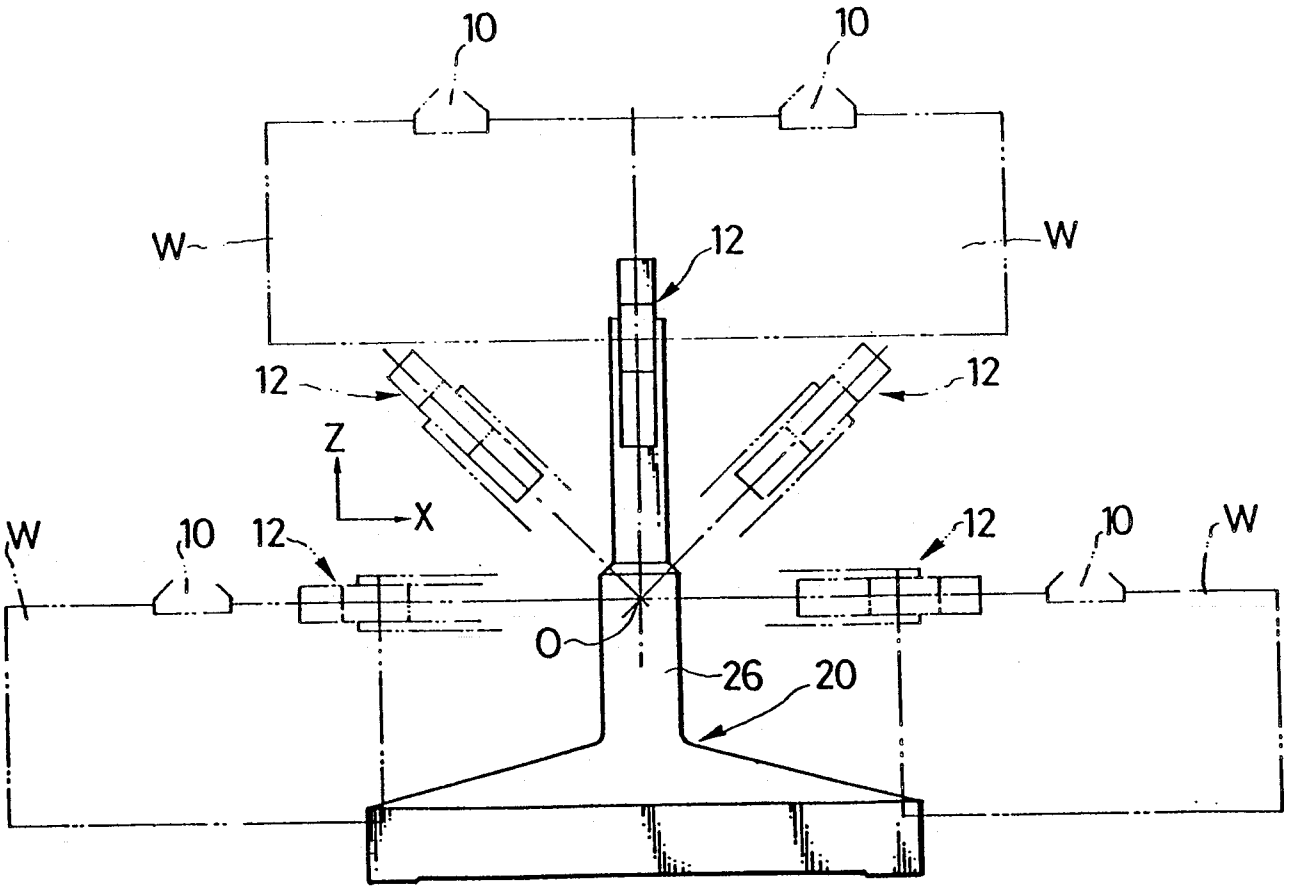
FIG. 7 is a schematic side elevational view of the same arrangement as shown in FIGS. 5 and 6, showing the possibilities for the relative positioning of a piece of sheet metal and a U-shaped pincer according to the invention.

As shown in FIG. 7, the pincer 12 is supported by a frame 20 so that it can pivot about an axis O which intersets the bending axis V, is parallel to the plane A of movement of the die D and is thus perpendicular to the plane B (parallel to the page of FIG. 6).

In FIG. 7, the frame 20 with the U-shaped pincer 12 and the clamp 10 are capable of relative movement both in a vertical direction Z and in a horizontal direction X perpendicular to the pivoting axis O. The amplitude of these translational movements in the directions Z and X are such as to enable the die D - punch p unit to reach all parts of a piece W having the maximum anticipated dimensions. The amplitude of pivoting of the pincer 12 is at least 180° between two positions in which it is oriented horizontally. This enables the die D- punch P unit to achieve bends of any inclination and in any region of a piece W. The ability of the pincer 12 to rotate through 180° about the bending axis V enables these bends to be achieved at any inclination in one sense or the other.

These possibilities are illustrated schematically in FIGS. 8 and 9 where the same parts, axes and directions are again indicated by the same references.

As already stated, the clamp 10 is adapted to support one end, such as $L_1$, of a piece W vertically in the plane B which is perpendicular to the pivoting axis O, and against the edge of the punch P, which coincides with the bending axis V.

The clamp 10, however, is preferably suspended in such a way as to enable limited free movement in the plane of suspension B with five degrees of freedom, excluding its rotation about an axis Y (FIG. 9) parallel to the pivoting axis O of the U-shaped pincer 12. In particular, with reference to FIG. 9, the clamp 10 can move vertically in the direction Z and horizontally in the directionx X and Y, and can rotate about X ($F_5$) and about Z ($F_6$) but not about Y ($F_7$).

These five degrees of freedom of movement enable the end, such as $L_1$ (FIG. 4), held by the clamp 10 to deviate from its theoretical plane of suspension B according to the diagrams of FIGS. 3*a, b, c* and *d*, as well as to follow the movements indicated by the arrows $F_2$ and $F_3$ in FIGS. 3*b, c* and *d*, whatever the orientation of the bending axis V. Its inability to rotate in the sense $F_7$, however, ensures that the bend is always oriented as desired with the maximum possible precision. As will be understood, the system described can form bends of quite complex shapes in a piece. As usual, successive of bends are still effected from the periphery to the centre of the piece.

As will also be understood, a complete bending cycle will not be possible with the same die-punch unit, either because longer or shorter units will be required from time to time or because units which are adapted to produce bends without sharp corners, such as, for example, creases, will sometimes be required. The system for the rapid changing of the tools (dies and punches) will be described below.

A preferred practical embodiment of a machine according to the invention will now be described with reference to FIG. 10 onwards. In these drawings, the parts already described are indicated by the same reference numerals.

Figure 10:
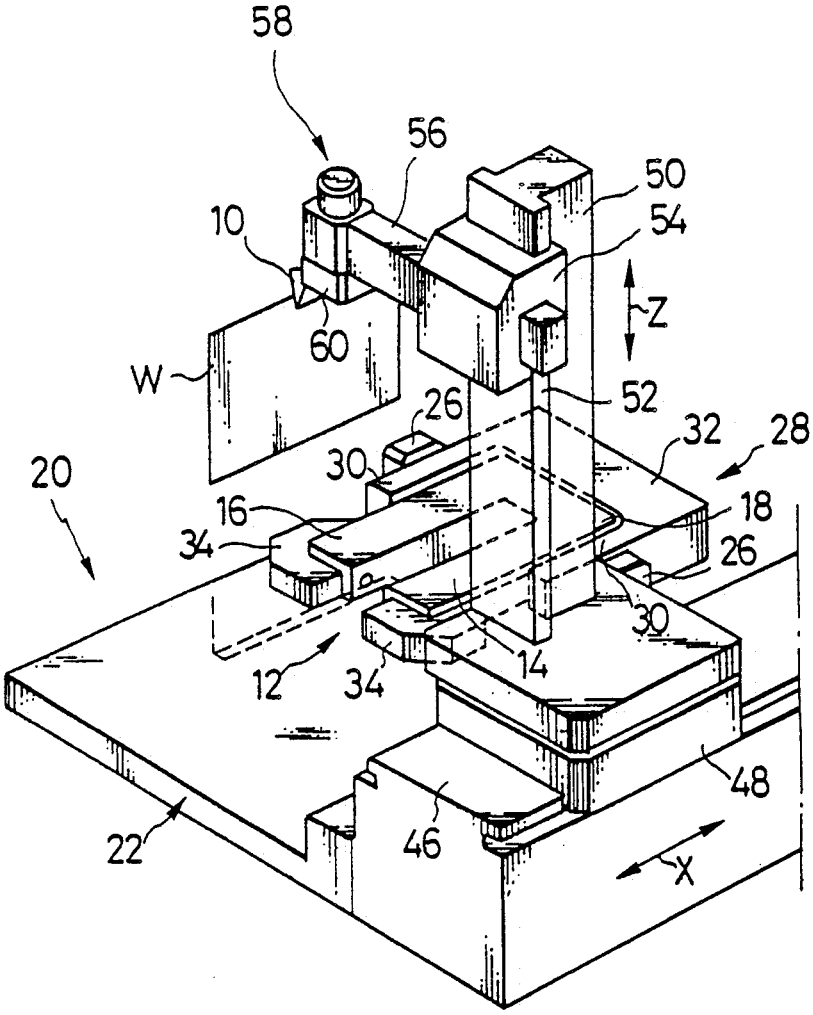
FIG. 10 is a perspective view of a preferred embodiment of the machine.
Figure 11:
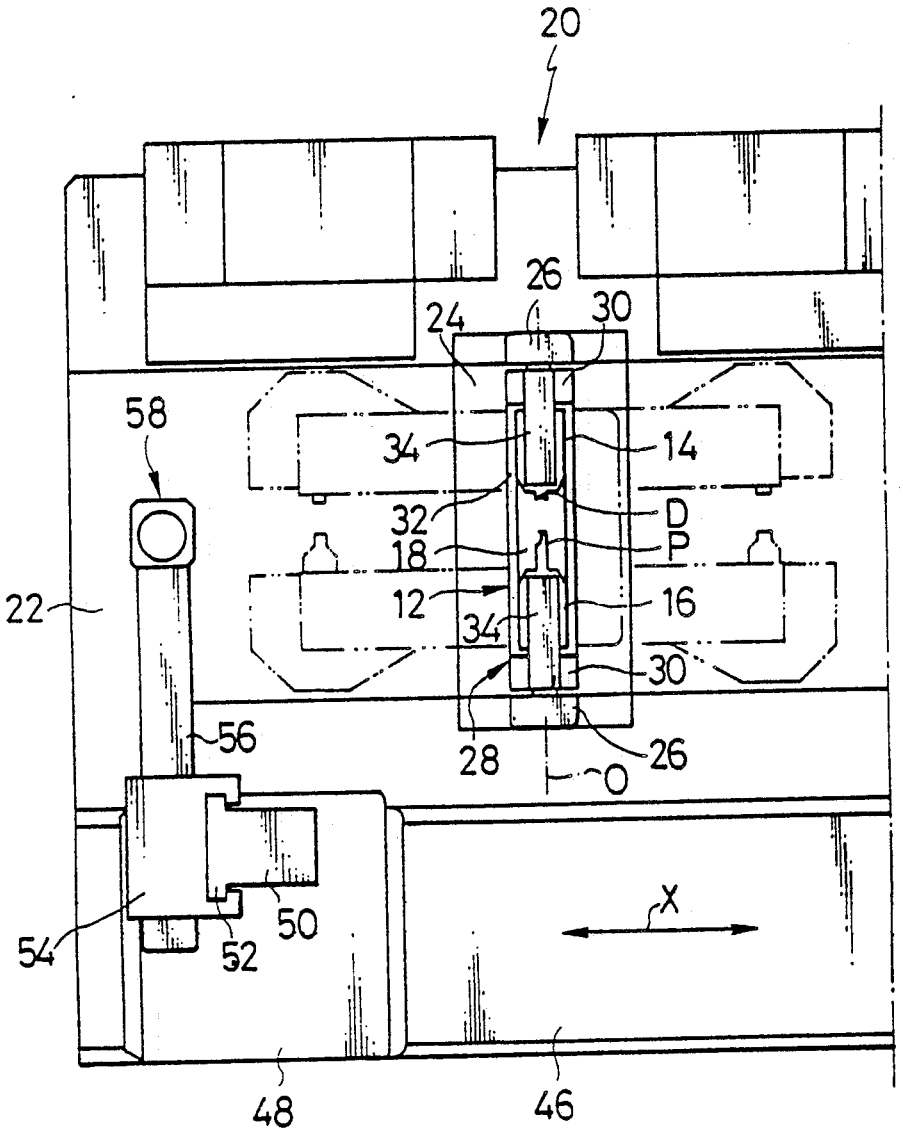
FIG. 11 is a plan view of the machine of FIG. 10.

With reference to FIGS. 10 to 13, the frame 20 of the machine includes a base 22 with a platform 24 from which rise opposing pillars 26, also visible in FIG. 7. A cradle, generally indicated by 28, is constituted by a strong C-shaped structure which comprises a pair of arms 30 and a cross member 32. The arms 30 are supported by the pillars 26 so that they can pivot about the axis O. Numerically-controlled servomotors (not shown) are incorporated in the pillars and enable the cradle 28 to be oriented through an angle of at least 180° about the pivoting axis O, as illustrated in FIGS. 7 and 11.

The yoke 18 of the pincer 12 is supported by the cross member 32 so that it can rotate about the bending axis V. The cross member 32 contains a numerically-controlled servomotor which enables the orientation of the frame 12 to be adjusted about the bending axis V, in the sense $F_4$.

Prior to a description of the suspension unit which includes the clamp 10, the system for changing the tools with which the machine is provided will be described.

As can be seen in FIGS. 10 to 14, the free ends of the arms 14 and 16 are forked and are provided with respective protective casings 34.

Figure 14:
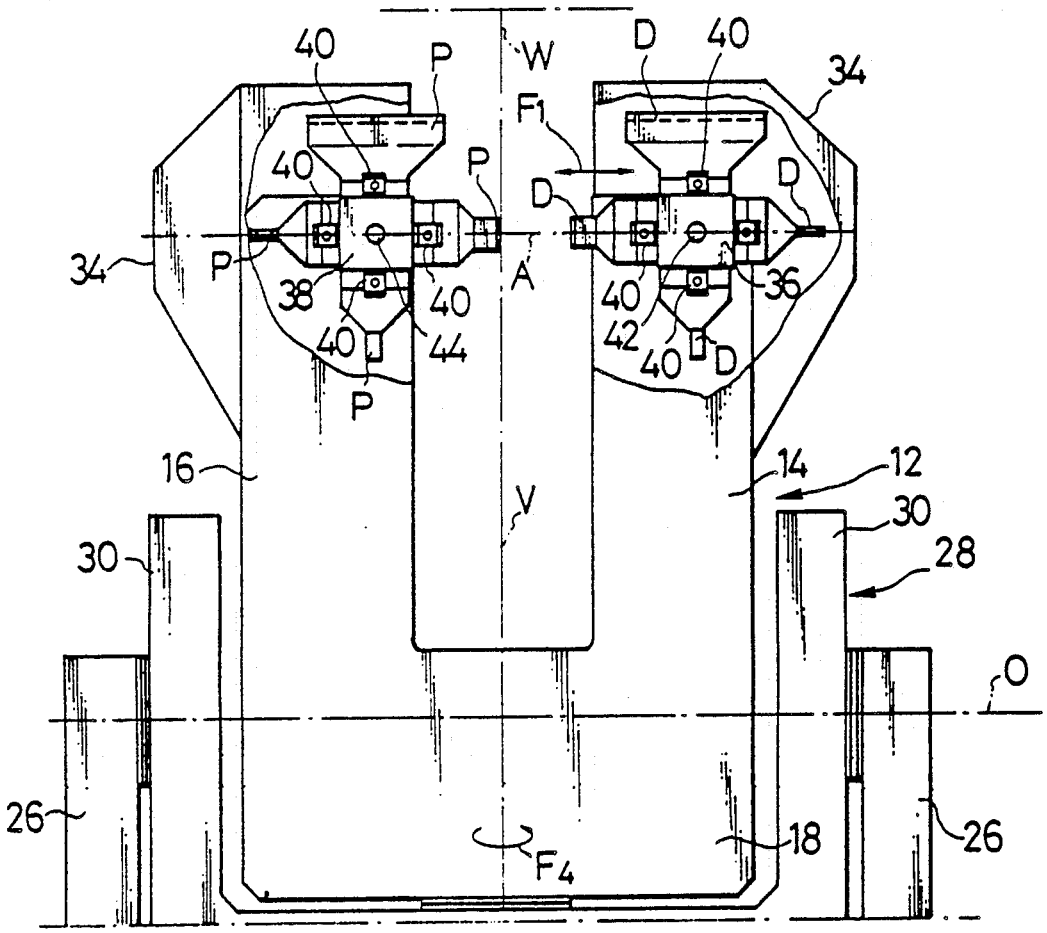
FIG. 14 is a partial elevational view partially cut away to show punch-carrying and die-carrying turrets incorporated in the arms of the U-shaped frame.

As illustrated in FIG. 14, respective tool-carrying turrets 36 and 38 are situated in the forks of the arms 14 and 16. The turret 36 of the arm 14 carries a plurality of dies D of different shapes and sizes (four in the case shown). The turret 38 of the arm 16 carries a corresponding plurality of punches P (four in the case shown). The dies D on the one hand and the punches P on the other are fixed to the respective turrets 36 and 38 in an interchangeable manner. Brackets or clamps for retaining the tools D and P in the respective turrets 36 and 38 are shown schematically by 40.

The two turrets 36 and 38 are pivoted at 42 and 44 respectively about respective axes perpendicular to a general plane of the pincer 12 which contains the bending axis V and the pivoting axis O. A servomotor is associated with each turret for rotating it in steps concomitantly with the other turret to replace the tools D, P in pairs. The servomotors are not shown. The axis of rotation of the turret 38 which carries the punches P is fixed relative to its arm 16. The axis of rotation of the turret 36 which carries the dies D, however, is movable in the direction of the arrow $F_1$ by means of another servomotor (not shown).

To advantage, the servomotors which drive the die in the direction of the arrow $F_1$ and the pincer 12 in the sense of the arrow $F_4$ are programmed so that, during bending, the end of the piece W held by the clamp 10 remains substantially stationary in the plane B.

With reference again to FIGS. 10 to 12, a strong horizontal fixed guide 46 is situated on one side of the platform 22 and carries a slide 48 which is movable in the direction X by means of a numerically-controlled servomotor (not shown). A vertical column 50 rises from the slide 48 and has a vertical guide 52. A slide 54 is movable along this guide in the direction Z by means of a numerically-controlled motor, not shown.

The slide 54 carries a strong cantilevered arm 56 mounted in the slide by a prismatic coupling. The arm 56 carries a suspension unit 58 at its free end, and this in turn carries the clamp 10. The arm 56 is mounted in the slide 54 in such a way that its horizontal extension can be adjusted in order to adjust the position of the clamp 10 in correspondence with the bending axis V.

As will be understood, by virtue of the arrangement described, the movements in the directions X and Z are achieved by movement of the piece-carrying apparatus, whilst the frame of the press is fixed.

Figure 15:
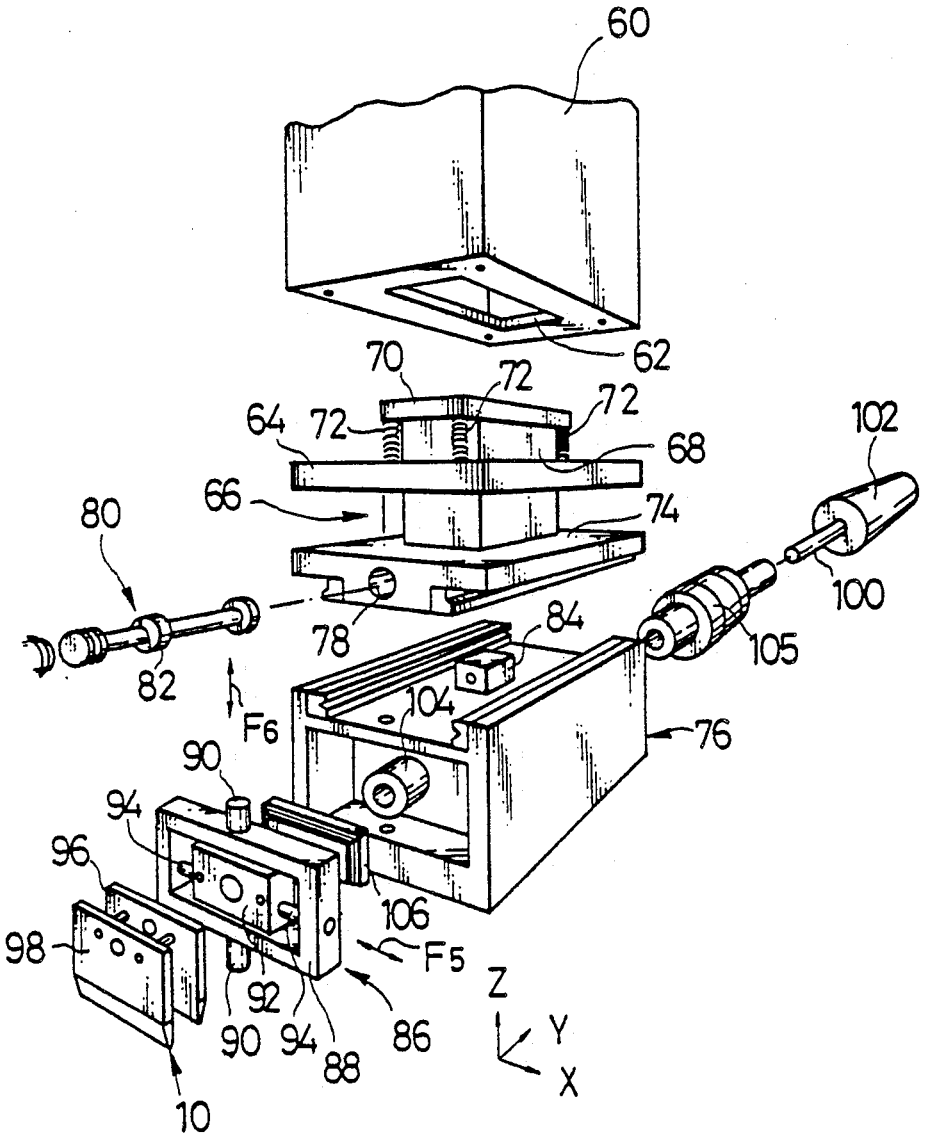
FIG. 15 is an exploded perspective view of a preferred embodiment of the piece-carrying unit of the machine.
Figure 16:
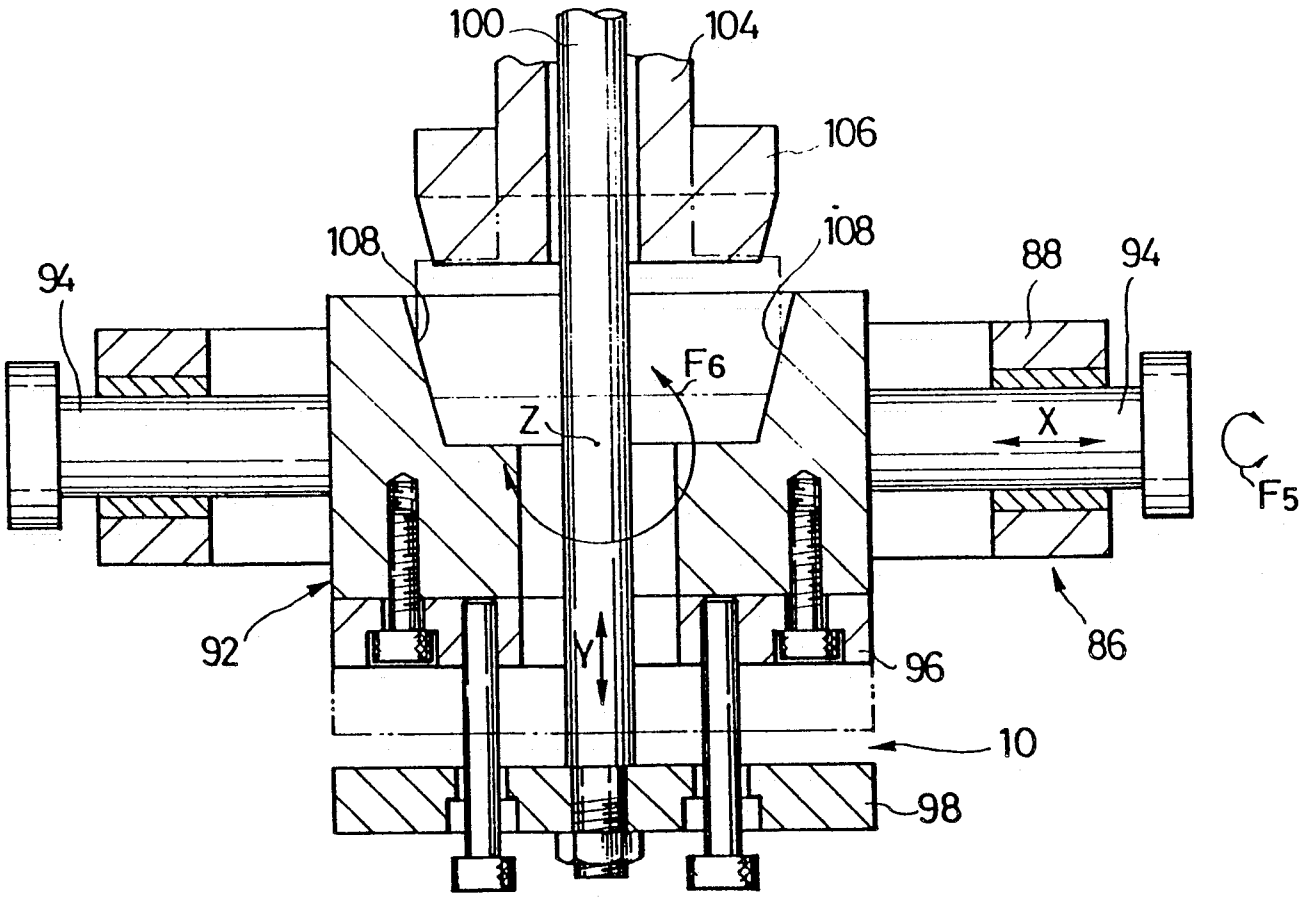
FIG. 16 is a partial horizontal section of the same piece-carrying apparatus as shown in FIG. 15.

With reference now to FIGS. 15 and 16, the details of a preferred embodiment of the suspension unit 58 will be described. As already mentioned, this unit 58 has the function of enabling the piece W to make small movements with five degrees of freedom, excluding rotation about the axis Y of FIG. 9.

Figure 12:
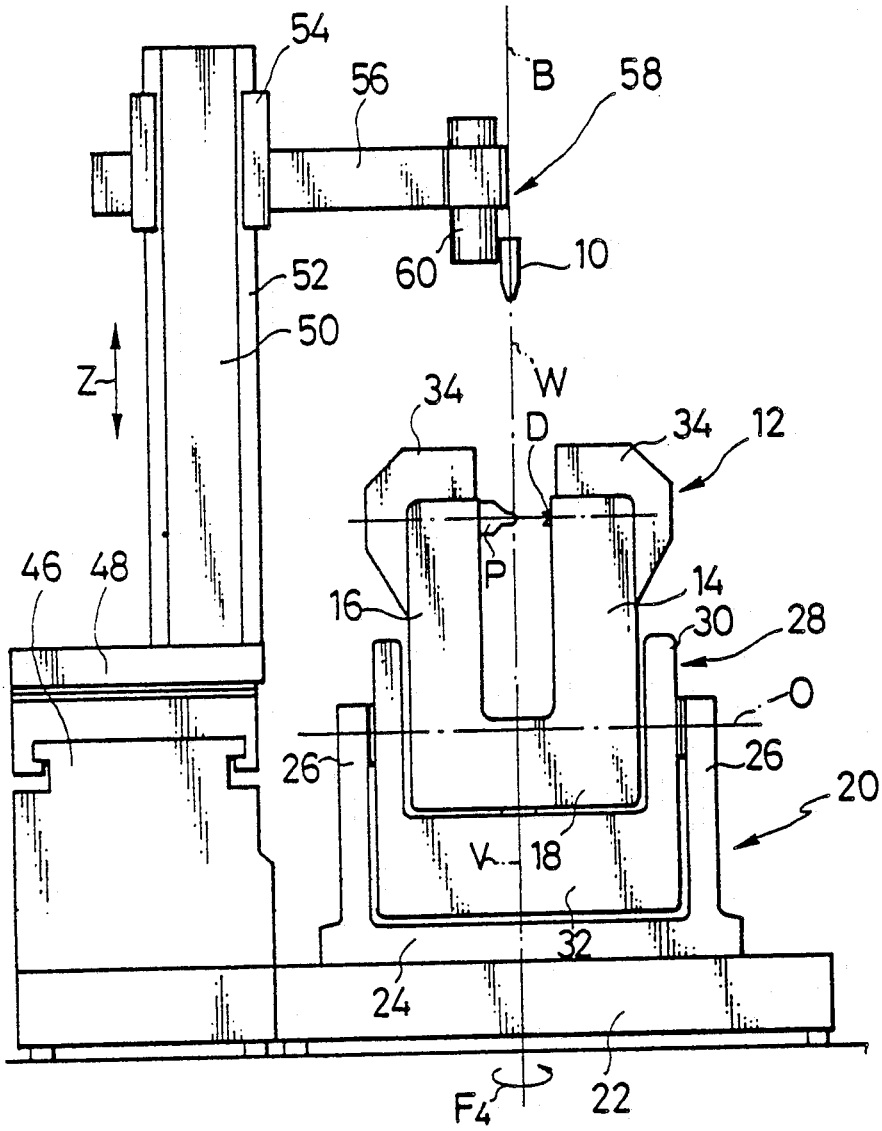
FIG. 12 is an end elevational view of FIG. 10.
Figure 13:
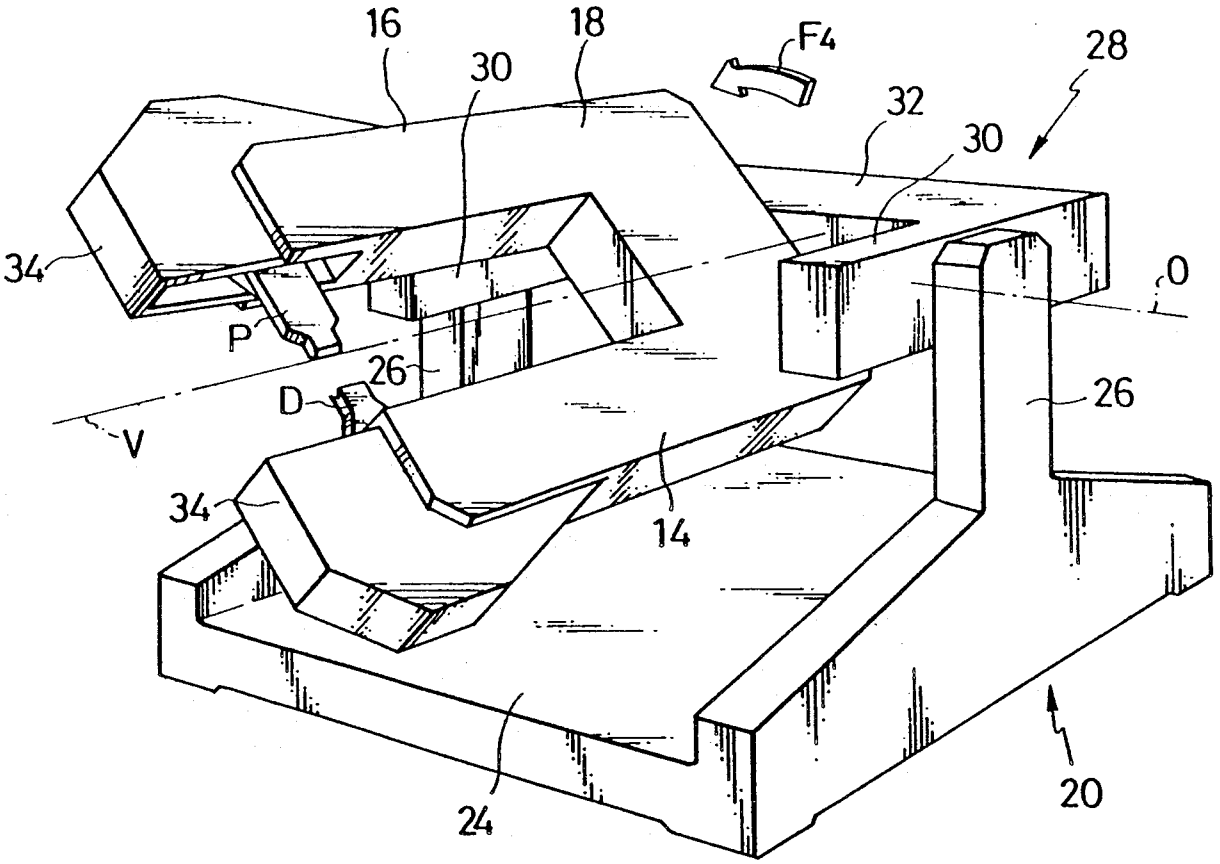
FIG. 13 is a perspective view of the single frame including the U-shaped pincer, on an enlarged scale.

The unit includes a suspension head 60, also visible in FIGS. 10 and 12, which is fixed to the arm 56. The head 60 has a prismatic cavity 62 defined at its lower end by an inserted frame 64. A first slide, generally indicated by 66, can slide vertically in the head 60 in the direction Z, with a limited travel. For this purpose, it includes a prismatic core 68 which is slidable in the direction Z with a precise prismatic coupling in the frame 64. The core 68 is defined at the top by a collar 70 which limits its travel. Springs 72 are interposed between the collar 70 and the frame 64 and support the weight of the whole system which is slidable in the direction Z. The rest position of the slide 66 is a halfway position in which it rests by gravity on the springs 72, which are compressed.

The core 68 is defined at its lower end by a horizontal plate part 74 which is shaped so as to constitute a horizontal guide for sliding in the direction Y. A second slide 76 is associated by prismatic coupling with the guide plate 74 and has a limited amount of travel in the direction Y.

A cylinder 78 is formed in the plate part 74 of the first slide 66 and houses a unit 80 which functions as a double-acting piston. The unit 80 includes a collar 82 which is firmly fixed to a block 84 forming part of the second slide 76.

The unit 78-80 constitutes a double-action pneumatic actuator which serves to return the second slide 76 in the direction Y to a central position in which the clamp is situated in correspondence with the initial bending plane B, after each bending operation.

The second slide 76 incorporates a universal joint, generally indicated 86, at one of its ends. This joint 86 includes a first ring 88 which is coupled to the slide 76 by means of vertical pins 90 which enable it to pivot about the vertical axis Z ($F_6$).

A second ring or central body 92 is situated in the first ring by 88 and is coupled thereto by means of horizontal pins 94 so that it can pivot about the horizontal axis X ($F_5$). The pins 94 also have a certain freedom of movement along their own axes to enable small movements of the clamp 10 in the direction X.

A fixed jaw 96 of the clamp 10 is fixed to the central body 92. The fixed jaw 96 is associated with a jaw 98 which is movable in the direction Y.

Fixed to the movable jaw 98 is one end of a rod 100 which extends in the slide 76 and whose other end forms part of a pneumatic actuator 102 incorporated in the slide 76 for tightening and slackening the clamp 10. The rod 100 is surrounded by a hollow rod 104 connected at one end to a pneumatic actuator 105 which is also incorporated in the slide 76. The other end of the hollow rod 104 carries a tapered head 106 which faces the clamp 10. The central body 92 of the universal joint 86 has, in its face opposite that which carries the fixed jaw 96, a countersunk cavity or seat 108 in the shape of a double dihedron with vertices along X and Z respectively. The head 106 can be wedged into the seat 108 by means of the actuator 105 to bring the plane of gripping of the clamp 10 into a plane parallel to the vertical plane B which includes the bending axis V.

Thus, by virtue of the actuators 80 and 105, it is always ensured that, after the completion of each bending operation, the gripping plane of the clamp 10 returns to a position which coincides with the initial bending plane B, and the axes X, Y and Z return to zero (particularly X and Z, by virtue of the countersinking of the seat 108), to the benefit of the precision of the next bending operation.

As will be understood, by virtue of the use of numerically-controlled servomotors to cause the various movements of the machine, the latter can be programmed for a complete cycle of bending of a piece, possibly with changing of the tools between one bending operation and another.

The plate bending machine according to the present invention has various advantages. The punch and the die is provided so as to be rotatable around the bending axis. Thus the worksheet to be bent can be firmly clamped by the worksheet clamping device during benging operation, in spite of the fact that the two ends of the worksheet situated opposite side of the bending axis are tilted to each other during the bending operation.

Further, the punch and the die is provided so that the bending axis thereof is rotatable around an axis perpendicular to the surface of the worksheet. Thus, a plurality of portion of the worksheet can be bent in single process sequence, i.e. without changing the attitude of the worksheet. Thus, during bending operation, the worksheet can be precisely positioned to bending axis of the punch and the die, and the bending operation can be quickly performed.

Although the invention has been described in its preferred embodiments, it is to be understood that various changes and modifications may be made within the purview of the appended claims without departing from the true scope and spirit of the invention in its broader aspects.

For example, the plate bending machine according to the present invention can be used for bending a large and heavy sheet metals, as well as for bending small and light pieces of sheet metal.

What is claimed is:

1. A plate bending machine comprising:

a punch and a die movable toward and away from each other for bending a workpiece in cooperation with each other, said punch having a bending edge extending along a line;

a first support means for supporting the punch and the die, the first support means being rotatable about a bending axis coincident with the bending edge of the punch;

a second support means for supporting the first support means, the second support means being pivotable about an axis intersecting the bending axis; and a workpiece support means for supporting the workpiece between the punch and the die with the plane of the workpiece extending vertically and perpendicularly to the pivoting axis of the second support means and said plane of the workpiece extending so as to contain the bending axis.

2. The plate bending machine of claim 1, wherein the first and second support means further comprise a pair of arms and a pair of turrets with the turrets each rotatably mounted on either one of the arms, for supporting a plurality of punches or dies.

3. The plate bending machine of claim 2, wherein the workpiece support means comprises:

means for clamping a workpiece so as to be disposed between at least one of the arms of the first and second support means; and column means for supporting the workpiece clamping means in a manner such that the workpiece is movable along an axis parallel to the plate surface of the workpiece.

4. The plate bending machine of claim 3, wherein the worksheet clamping means comprises a pair of jaws for clamping the worksheet therebetween, and a universal joint means for supporting the jaws in a pivotable manner around a pair of axes, the pair of axes lying in a plane parallel to the surface of the worksheet and intersecting with each other.

5. The plate bending machine of claim 4, wherein the worksheet clamping means further comprising means for restraining the universal joint means from pivoting.

6. The plate bending machine of claim 5, wherein said universal joint comprises a ring member supported on the column means so as to be pivotable around a first axis lying in the plane parallel to the surface of worksheet, and a central member supported on the ring member so as to be pivotable around a second axis lying in the plane parallel to the worksheet surface, and intersecting with said first axis; and said restraining means comprises an engage member mounted on the column means and capable to engage an engage portion formed in the control member of the universal joint.

7. The plate bending machine of claim 3, wherein said worksheet clamping means comprises a pair of jaws for clamping the worksheet therebetween; and means for supporting said pair of jaws in a movable manner relative to the column means in a direction parallel to the surface of the worksheet.

8. The plate bending machine of claim 7, wherein said worksheet clamping means further comprising means for restraining the pair of the jaws from moving in the direction parallel to the surface of the worksheet.

9. The plate bending machine of claim 8, wherein the worksheet supporting means further comprising means mounted on the column means, for supporting the pair of the jaws in a movable manner in a direction perpendicular to the surface of the worksheet.

* * * * *